United States Patent [19]

Rebas

[11] Patent Number: 4,571,283

[45] Date of Patent: Feb. 18, 1986

[54] REVERSIBLE SLICE LIP

[75] Inventor: Erich Rebas, Pierrefonds, Canada

[73] Assignee: Valmet-Dominion Inc., Lachine, Canada

[21] Appl. No.: 667,584

[22] Filed: Nov. 2, 1984

[30] Foreign Application Priority Data

Dec. 2, 1983 [CA] Canada ..... 442482

[51] Int. Cl.[4] ..... D21F 1/06

[52] U.S. Cl. ..... 162/344; 162/336

[58] Field of Search ..... 162/336, 344, 345, 346, 162/347; 428/167, 157; 30/346.5, 346.61

[56] References Cited

U.S. PATENT DOCUMENTS 967,500 8/1910 Clark ..... 30/346.61
1,020,796 3/1912 Buck ..... 30/346.5
3,310,461 3/1967 Erbach ..... 162/344
3,976,539 8/1976 Kirjavainen ..... 162/344

OTHER PUBLICATIONS

"Pulp and Paper Making Notes", Scott Paper Company, Jan. 1956, pp. 208–209.
"Headbox Slice Lip and Slice Lip Adjusters", Manual J006–10004, Beloit Corp., Feb. 1978.

*Primary Examiner*—S. Leon Bashore
*Assistant Examiner*—K. M. Hastings
*Attorney, Agent, or Firm*—Raymond A. Eckersley

[57] ABSTRACT

A reversible slice lip for paper machine is formed with two discrete slice edges extending substantially parallel and forming opposite longitudinal edges of the slice lip. The slice lip is provided with a mounting means and is formed substantially symmetrical about its longitudinal axis so that it may be mounted on the headbox with one or the other of the slice edges in operative position.

4 Claims, 3 Drawing Figures

REVERSIBLE SLICE LIP

FIELD OF THE INVENTION

The present invention relates to a slice lip for a paper making machine. More particularly the present invention relates to a reversible slice lip having a pair of substantially parallel slice edges positioned one at each side of the slice lip.

BACKGROUND TO THE INVENTION

In the manufacture of paper, a slurry is ejected from a headbox to the forming wire or wires of the machines. The outlet from the headbox must be accurately formed to control the jet thickness transversely of the machine and thereby form a paper web of uniform cross-machine basis weight profile, i.e., having substantially the same basis weight across the width machine. To attain this result the slice lip which defines an edge of the orifice, i.e., extending transversely across the paper machine, must be accurately positionable and requires discrete adjustments at spaced locations transversely of the web to adjust locally the basis weight of the paper being formed. The slice edge, i.e., the operative or effective edge of the slice lip, therefore is not normally parallel with the apron lip that forms the opposite side of the headbox outlet, since as above indicated minor variations in flow across the headbox are adjusted by adjusting locally the relative spacing between the slice lip edge and the cooperating apron lip. Thus the slice lip itself must have at least limited flexibility so that it may be deformed locally to make these adjustments.

The slice lip, since it forms one of the working edges of the orifice outlet from the headbox, is obviously subjected to wear and on occasion may be damaged by foreign material or the like passing through the headbox and scraping the slice lip. When this happens or when the slice lip wears significantly, it is necessary to remove the slice lip and replace it with a new one or with another slice lip that has been reconditioned. This practice has been carried on in the paper making industry it is believed since the inception of the adjustable and replaceable slice lip was introduced.

BRIEF DESCRIPTION OF THE INVENTION

It is the object of the present invention to provide a double edged slice lip so that the slice lip will have double the expected life of a conventional slice lip.

Broadly, the present invention relates to a reversible slice lip for a headbox of a paper making machine said slice lip having a bottom surface, a first slice edge along one longitudinal edge of said bottom surface and a second slice edge spaced from and substantially parallel to said first slice edge, said second slice edge being along the side of said bottom surface remote from said one side edge. Means for mounting the slice lip on the headbox from the side of the slice lip remote from said bottom surface, said slice lip being substantially symmetrical on opposite sides of its longitudinal centerline.

Preferably each of the slice edges will be formed at the junction of a substantially planar bottom surface with a corresponding side surface meeting the said bottom surface at a right angle.

DESCRIPTION OF THE PREFERRED EMBODIMENT

Figure 1:
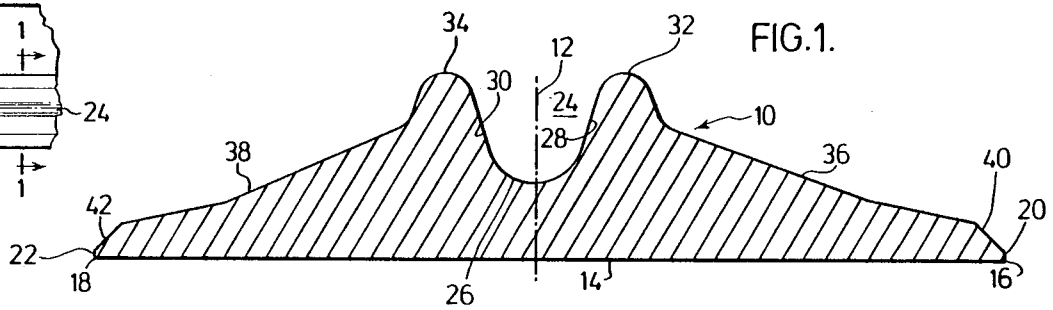
FIG. 1 is a transverse cross-section of a slice lip constructed in accordance with the present invention and taken along lines 1—1 of FIG. 3.

The slice lip 10 of the present invention is substantially symmetrical about its longitudinal centerline as indicated by the centerline 12 in FIG. 1.

The slice lip 10 is formed with a bottom surface 14 that is substantially planar. The slice edges 16 and 18, which extend substantially parallel to the longitudinal centerline of the slice lip 10, are formed at the junction of the bottom surface 14 with the side surfaces 20 and 22 respectively. It will be noted that the side surfaces 20 and 22 are substantially perpendicular to the bottom surface 14.

A central longitudinally extending well 24 is formed along the longitudinal centerline 12 of the slice lip 10, is symmetrical on opposite sides of this centerline 12 and has a substantially arcuate bottom 26 extending up into a pair of side walls 28 and 30 which in turn are formed into crowns 32 and 34 that are curved downward and mate with upper side walls 36 and 38 that extend to the angular connecting walls 40 and 42 that connect the side walls 20 and 22 to the upper walls 36 and 38, respectively.

Figure 2:
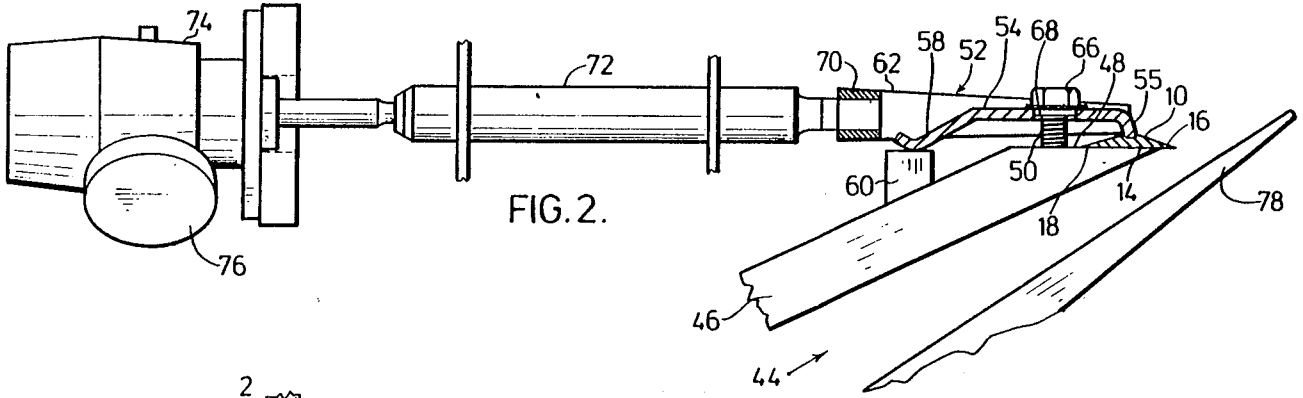
FIG. 2 is a partial section along the lines 2—2 of FIG. 3 showing a slice lip mounted in position on a headbox together with means for adjusting the position of the slice lip.

The slice lip 10 is mounted on the headbox, generally indicated at 44, in FIG. 2 in any suitable manner. In the arrangement illustrated, the slice lip 10 is mounted on the slice frame lip 46 with the bottom surface 14 of the slice lip 10 in face-to-face relationship with a planar surface 48 on the slice frame lip 46. A suitable stud 50 projects upwardly from the face 48 and functions to clamp the slice lip 10 in position, as will be described hereinbelow.

Figure 3:
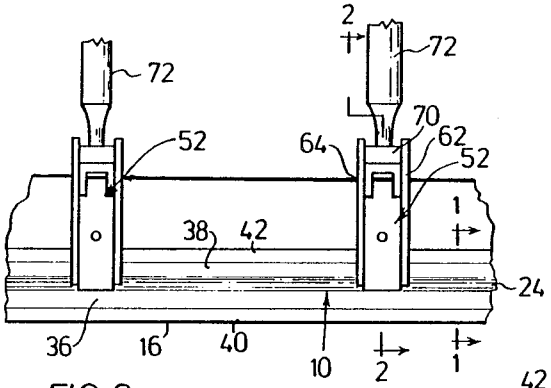
FIG. 3 is a partial view looking in the direction of the arrow 3 of FIG. 2 showing a pair of slice adjusting means located at spaced locations along the length slice lip.

A suitable spring generally indicated at 52 as shown most clearly in FIGS. 2 and 3 is composed of a main body section 54 having a front lip 56 that is received within the passage or slot 24 in the slice lip 10 and with a trailing leaf spring element 58 that bears against a stop 60 formed on the slice frame lip 46. In the arrangement illustrated, the main body section 54 spring member 52 is connected to side flanges 62 and 64 formed one at each of the opposite sides of the spring member 52.

To mount the slice lip 10 in position, the lip 56, as above indicated, is received within the passage 24 the leaf element 58 bears against the boss 60 and the nut 66 is tightened onto the stud 50 to force the element 58 against the boss 60 and the lip 56 to press the surface 14 against the upper surface 48 of the slice frame lip 46 whereby the lip 10 is resulting held in position.

The stud 50 fits within a slot 68 in the body 54 of the spring 52 to permit movement of the spring and thus of the area of the slice to which it is connected, i.e., to permit the surface 14 to slide along the surface 48 by movement of the spring member 52 relative to the surface 48 thereby the slice lip can be locally adjusted relative to the frame lip 46. This movement of the slice lip is obtained by means of a member 70 connected to the rear of the side members 62 and 64, which in turn is connected via a bar or rod member 72 to a servo mechanism 74 which may be adjusted by means of a micrometer handwheel 76 to move the spring member 52 and thus the slice member 10 backward and forward, i.e., up and down along the surface 48 of the slice frame lip 46 thereby to adjust the position of the edge, say edge 16, of the slice lip 10 relative to the apron lip 78 of the headbox 44.

It will be noted that there are a plurality of spring members 52 spaced transversely across the machine (two are shown in FIG. 3) generally they will be spaced approximately six inches apart and each will be provided with its own discrete adjusting mechanism comprising the bar member 72, servo mechanism 74 etc.

As indicated, the slice lip 10 will be mounted as shown in FIGS. 2 and 3 and adjusted relative to the apron lip 78 to obtain the desired local flow by individually moving the spring members 52 spaced transversely of the headbox toward and away from lip 78. When the edge, say edge 16, becomes worn, it is merely necessary to release the slice lip 10, turn it end for end so that the edge 18 now becomes the edge adjacent the apron lip 78 and then reposition this edge 18 to accurately control the flow of stock issuing from the headbox 44.

Having described the invention modifications will be evident to those skilled in the art without departing from the spirit of the invention as defined in the appended claims.

What I claim as new and desire to secure by Letters Patent of the United States of America is:

1. In a headbox of a paper making machine, a slice lip, said slice lip having a longitudinal centerline and a bottom surface, a first slice edge formed by a junction defined by the intersection of one longitudinal side edge with said bottom surface, said first slice edge being in operative position defining one side of a slice opening from said headbox, a second slice edge spaced from, and substantially parallel to said first slice edge, said second slice edge being formed by a junction defined by the intersection of a second longitudinal side edge with said bottom surface, said first and second longitudinal side edges being substantially parallel to said longitudinal centerline, and at least those portions of said bottom surface adjacent said junction of said one and said second longitudinal side edges being in a common plane, means for mounting said slice lip on said headbox, said slice lip being substantially symmetrical on opposite sides of said longitudinal centerline, said means for mounting including mounting means provided on the surface of said slice lip opposite from said bottom surface and spaced from and located between said first and said second slice edges, whereby said means for mounting said slice lip may be released and said slice lip turned end for end and said second slice edge positioned to define said one side of said slice opening.

2. A slice lip as defined in claim 1 wherein said bottom surface is substantially planar.

3. A slice lip as defined in claim 2 wherein said one and said second longitudinal side edges each approach said bottom surface at substantially a right angle thereto.

4. A slice lip as defined in claim 3 wherein said mounting means comprises a trough formed in said slice lip on the surface of said slice lip opposite from said bottom surface, said trough extending along said longitudinal centerline of said slice lip.

* * * * *